United States Patent [19]

Harrison

[11] 4,068,151

[45] Jan. 10, 1978

[54] REGULATED STROBE WITH HYSTERESIS

[75] Inventor: George C. Harrison, Chelmsford, Mass.

[73] Assignee: Polaroid Corporation, Cambridge, Mass.

[21] Appl. No.: 743,115

[22] Filed: Nov. 19, 1976

[51] Int. Cl.[2] ..... H05B 41/32

[52] U.S. Cl. ..... 315/241 P; 315/225; 320/1

[58] Field of Search ..... 315/241 P, 241 R, 219, 315/225; 320/1; 354/145

[56] References Cited

U.S. PATENT DOCUMENTS

| | | | |
|---|---|---|---|
| 3,012,181 | 5/1961 | Schultz | 315/241 P X |
| 3,777,212 | 12/1973 | Mashimo | 315/241 P |
| 3,822,393 | 7/1974 | Karpol | 315/241 P |
| 3,863,128 | 1/1975 | Wilwerding | 315/241 P X |

*Primary Examiner*—Eugene R. LaRoche
*Attorney, Agent, or Firm*—Edward S. Roman

[57] ABSTRACT

A simplified voltage regulating circuit is provided for controlling the operation of a d-c to d-c converter oscillator as is commonly used in an electronic flash. The voltage regulating circuit controls the operation of the d-c to d-c converter so that the output voltage from the oscillator is maintained within a prescribed range. The voltage regulating control circuitry includes an ordinary transistor controlled by way of an output voltage sensing zener diode which operates to turn on the transistor and thereby terminate operation of the oscillator when the output voltage therefrom reaches its maximum value within the prescribed range. A capacitor is also charged by way of the transistor when it turns on and the residual charge of the capacitor thereafter operates regardless of the non-conductive state thereafter assumed by the zener diode and transistor to maintain the oscillator off until the output voltage from the oscillator decays to its minimum value within the prescribed range.

15 Claims, 1 Drawing Figure

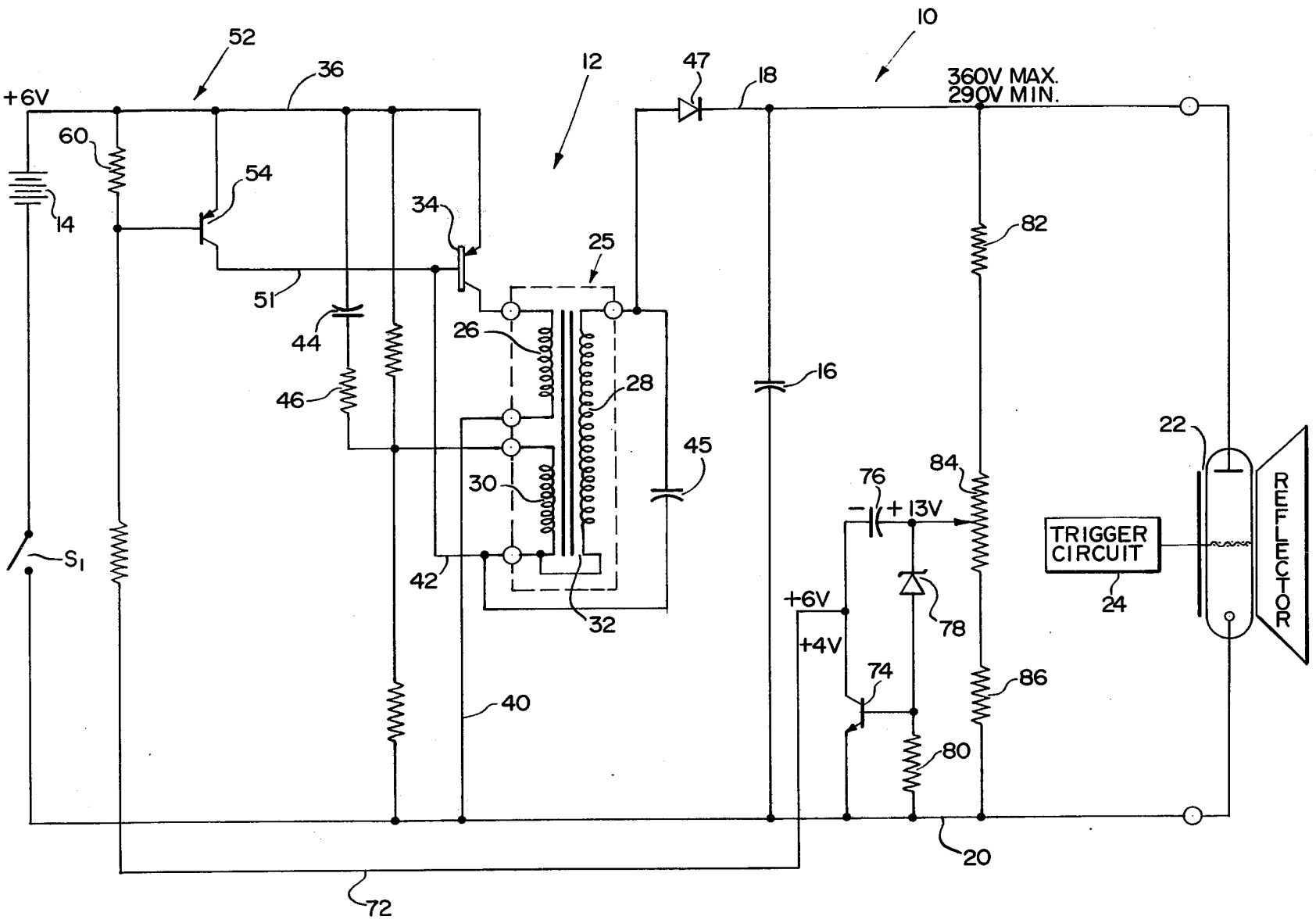
REFLECTOR
22
TRIGGER CIRCUIT
24
360V MAX.
290V MIN.
82
86
84
78
80
20
10
+13V
76
74
+6V
+4V
16
18
47
45
28
25
32
12
26
30
40
34
42
72
36
44
46
51
52
54
60
14
+6V
S1

REGULATED STROBE WITH HYSTERESIS

BACKGROUND OF THE INVENTION

1. Field of the Invention

This invention relates generally to a regulated converter circuit with hysteresis and, more particularly, to a regulated d-c to d-c oscillator converter circuit with hysteresis for use in electronic flash devices.

2. Description of the Prior Art

Typical photographic electronic flash devices utilize a battery powered d-c to d-c converter oscillator for charging a flash storage capacitor which may be thereafter selectively discharged through a flashtube to produce a flash of light for illuminating a photographic scene. It is also well known to provide means for automatically controlling the output voltage from the oscillator to the storage capacitor within a desired range in order to achieve a minimum battery drain. One such circuit for this purpose as disclosed in U.S. Pat. No. 3,316,445, entitled "Transistorized Power Supply for a Storage Capacitor with a Regulating Feedback Control" issued Apr. 25, 1967, teaches the use of a neon lamp for feeding back a sample of the output voltage to a switching circuit for controlling the operation of the oscillator. Thus, when the output voltage has reached a desired value, the neon lamp conducts and causes current to flow through it to the switching circuit which, in turn, alters the bias on the oscillator to cause it to terminate operation. When the output voltage of the storage capacitor thereafter discharges to a predetermined value, the neon lamp current is diminished to a critical value and the switching circuit returns to its conductive state so as to apply a suitable bias to the oscillator to cause it to again start oscillating. However, as a result of the inherent instability and high hysteresis of such neon lamps, arrangements employing such lamps have permitted the capacitor voltages to vary between oscillator turn on and turn off by as much as 30% or more. This amounts to an unsatisfactory performance in many instances. Also, the inherently very small hysteresis provided by diodes has made them generally unsatisfactory when employed in the foregoing manner, since this characteristic has resulted in a too frequent on-off cycling of the oscillator.

One such arrangement which overcomes the aforementioned difficulties is disclosed in a U.S. Pat. No. 3,863,128 entitled "Voltage Monitoring Controlling and Protecting Apparatus Employing Programmable Unijunction Transistor", issued Jan. 28, 1975, which teaches various circuit configurations, each of which includes a programmable unijunction transistor in a circuit which compares a voltage to be monitored with a corresponding preset reference voltage and controlls the operation of the power supply in accordance with the results of this comparison. Such a circuit requires two zener diodes in addition to the programmable unijunction transistor as well as additional circuitry which contributes to the overall complexity of the control circuit arrangement.

It is, therefore, an object of this invention to provide a simplified control circuit for effectively terminating the operation of a d-c to d-c converter oscillator when the output voltage thereof increases to a predetermined maximum value and for thereafter restarting the operation of the oscillator when the output voltage decays to a predetermined minimum value.

It is a further object of this invention to provide a simplified control circuit for controlling the operation of a d-c to d-c converter oscillator wherein the control circuit has a desired hysteresis which prevents the oscillator from cycling on and off in too frequent a manner.

It is an even further object of this invention to provide a simplified control circuit for controlling the operation of a d-c to d-c converter oscillator as may be used in a photographic electronic flash device to maintain the output voltage thereof within a desired range in order to protect the storage capacitor from incurring unduly high capacitor voltages while at the same time protecting the battery from being excessively discharged.

It is also an object of this invention to provide a simplified control circuit for controlling the operation of a d-c to d-c converter oscillator as may be used in a photographic electronic flash device in the aforementioned manner without utilizing a programmable unijunction transistor in combination with two zener diodes.

Other objects of the invention will, in part, be obvious and will, in part, appear hereinafter.

SUMMARY OF THE INVENTION

An electronic flash apparatus having a flash tube, a d-c to d-c converter oscillator and an energy storage capacitor connected to receive an output voltage and charging current from the oscillator is further provided with a voltage regulating control circuit. The control circuit terminates the operation of the d-c to d-c converter oscillator when the output voltage thereof increases to a predetermined maximum value and also restarts the operation of the oscillator when the output voltage thereafter decays to a predetermined minimum value. The control circuit includes: a first transistor having a collector terminal, an emitter terminal and a base terminal in series connection with a circuit element which becomes conductive upon the application of a voltage at least equal to a predetermined potential proportional to the predetermined maximum value. The circuit element also renders the transistor at least partially conductive in response to the output voltage of the oscillator reaching the predetermined maximum value, while thereafter becoming substantially non-conductive in response to the output voltage of the oscillator decaying below the predetermined maximum value to render the transistor substantially non-conductive. A capacitor is connected with respect to the transistor so as to charge to a first select potential in response to the rendering of the transistor at least partially conductive whereby the charging of the capacitor occurs before the output voltage of the oscillator can decay below a value at which the circuit element again becomes substantially non-conductive. Additional circuitry is connected between the transistor and oscillator for terminating the operation of the oscillator in response to the rendering of the transistor at least partially conductive. The additional circuitry also operates in response to the discharge of the capacitor from the first select potential to a second select potential subsequent to the rendering of the transistor substantially non-conductive to maintain the termination of the operation of the oscillator. The additional circuitry also operates thereafter to restart the operation of the oscillator in response to the voltage of the capacitor reaching the second select potential, wherein the second select potential is determined so as to occur at a time generally corresponding to the time at which the output voltage from the oscillator decays to the predetermined minimum value.

DESCRIPTION OF THE DRAWINGS

The novel features that are considered characteristic of the invention ar set forth with particularity in the appended claims. The invention itself, however, both as to its organization and its method of operation, together with other objects and advantages thereof will be best understood from the following description of the illustrated embodiment when read in connection with the accompanying drawing wherein:

The drawing is a schematic diagram for an electronic flash circuit embodying the voltage regulating control circuit of this invention.

DESCRIPTION OF THE PREFERRED EMBODIMENT

Referring now to the drawing, there is shown a schematic diagram for an electronic flash device 10 of the type used for illuminating a scene or subject to be photographed. The flash device 10 includes a d-c to d-c converter as shown generally at 12 which may be powered by a direct current, low voltage, source such as a battery 14. A flash storage capacitor 16 is connected between a pair of conductors 18 and 20 which, in turn, are connected to receive the output voltage from the oscillator 12. Thus, the oscillator 12 furnishes charging current to the capacitor 16 so that the output voltage from the oscillator increases in correspondence with the charging of the storage capacitor 16.

There is also provided a flashtube 22 in parallel connection with respect to the storage capacitor 16. The capacitor 16 may be selectively discharged through the flashtube to produce a flash of light for illuminating a photographic subject in a well-known manner. Such a selective discharge of the capacitor 16 through the flashtube 22 may be accomplished by a triggering circuit 24 shown in the drawing in block diagram form. The triggering circuit 24 may be of any suitable circuitry known in the art for triggering flashtube 22.

The oscillator 12 may be of any of the known types of oscillators customarily employed for charging capacitors and is shown to include a transformer 25 having a primary winding 26, a secondary winding 28, a feed-back winding 30, and a magnetic core 32. The oscillator 12 also includes a power transistor 34 of the PNP type having an emitter terminal connected to the positive terminal of the battery 14 by way of a conductor 36. Transistor 34 also includes a collector terminal connected directly to one side of the primary winding 26 of the transformer 25. The negative terminal of the battery 14 is connected to the other side of the primary winding 26 by way of the conductors 20 and 40. For regenerative purposes, one end of the feed-back winding 30 is connected to the base terminal of the transistor 34 with the other end connected to the emitter terminal of the transistor 34 by way of a bypass capacitor 44 in series connection with a resistor 46. A capacitor 45 is connected across the secondary winding 28 to form a resonant circuit therewith. The upper end terminal of the secondary winding 28 is connected through a diode 47 to the conductor 18 in order to provide a uni-directional charging current to the storage capacitor 16.

A control circuit to be subsequently described is provided for effectively terminating the operation of the d-c to d-c converter oscillator 12 when the oscillator and output storage capacitor 16 voltage increases to a predetermined maximum value and for thereafter restarting the operation of the oscillator 12 when the output voltage on the storage capacitor 16 decays to a predetermined minimum value. Referring now to a portion of the control circuit as shown generally at 52, there is included a PNP transistor 54 of which the emitter terminal is in direct connection with the positive terminal of the battery 14 by way of the conductor 36 and a collector terminal is in direct connection to the base terminal of transistor 34 by way of a conductor 51. The base terminal of transistor 54 in turn is connected to the positive terminal of the battery 14 by way of a resistor 60 and the conductor 36. Current flow through the base terminal of transistor 54 is controlled by way of an NPN transistor 74, the collector terminal of which is in direct connection to the base terminal of transistor 54 by way of an interconnecting conductor 72 and the emitter terminal of which connects directly to the ground terminal of the battery 14 by way of the conductor 20. The base terminal of the transistor 74, in turn, is biased by way of a resistor 80 interconnecting it to the conductor 20 and a zener diode 78 connecting directly to the slider of a potentiometer 84. The slider of potentiometer 84 additionally connects to the collector terminal of the transistor 74 by way of a capacitor 76. The potentiometer 84, in turn, is in series connection with a pair of resistors 82 and 86 which collectively define a resistive divider network between the conductors 18 and 20.

Operation of the circuit may proceed as follows. As is readily apparent, closure of a switch $S_1$ will start the operation of the oscillator 12 so as to charge the capacitor 16 to a voltage well above the voltage of the battery 14. Thus, the oscillator operates to transfer the energy of the battery 14 progressively to the capacitor 16 whereby the capacitor charge and the voltage between the conductors 18 and 20 rises progressively with time in the usual manner. The specific manner in which the oscillation of the oscillator 12 causes the charge in voltage on the capacitor 16 to rise progressively with time is well-known in the art and not relative to the instant invention. For purposes of illustration, it will be assumed that the d-c battery voltage is the order of 6 volts and that the predetermined maximum voltage to which it is desired to charge the capacitor 16 is in the order of 360 volts. The zener diode 78 has also been selected to conduct at 13 volts. The slider of potentiometer 84 has been set so as to provide a voltage of approximately 13.5 volts when the output voltage at line 18 reaches its maximum value of 360 VDC.

Thus, previous to the oscillator output and capacitor voltage at line 18 reaching it desired maximum value of 360 VDC, it is readily apparent that the zener diode 78 will be in a substantially non-conductive state so as to block the flow of base current to the transistor 74. Thus, transistor 74 will also assume a substantially non-conductive state so as to block the flow of base current from the transistor 54 thereby causing transistor 54 to also assume a substantially non-conductive state which, in turn, permits power transistor 34 to remain conductive. In this manner oscillator 12 is maintained in operation while capacitor 16 is charged with the control transistor 54 and 74 remaining in substantially non-conductive states. During this time, the capacitor 76 is also charged with a positive voltage appearing at the capacitor terminal common to the potentiometer 84 slider when the voltage at the slider reaches 6 volts. Thus, a continued increase in the output voltage at conductor 18 operates to effect a flow of current serially through the resistor 82, potentiometer 84, capacitor 76, conductor 72, resistor 60, and line 36 back to the positive 6 volt terminal of the battery 14. In this manner, the capacitor 76 is charged with the voltage polarity being positive at that capacitor terminal which connects directly to the potentiometer 84 slider.

When the oscillator output and capacitor voltage on conductor 18 reaches its predetermined maximum value of 360 VDC, there will be effected a corresponding increase in the voltage level at the potentiometer 84 slider to 13.5 VDC, which in turn will cause a partial conduction through the zener diode 78 to the base terminal of transistor 74 so as to cause transistor 74 to become partially conductive between the collector and emitter terminals. The increased conduction through the transistor 74, in turn, operates to increase the current flow from the base terminal of transistor 54 by way of conductor 72 so as to cause transistor 54 to also assume a state of partial conduction. This, in turn, limits the current flow from the base terminal of power transistor 34 so as to turn off transistor 34 and thereafter terminate the operation of the oscillator at an instant corresponding to the output voltage reaching its predetermined maximum value of 360 VDC. As is now readily apparent, immediately prior to the transistor 74 turning on, the capacitor 76 is charged to approximately 6.5 VDC. Immediately following the turning on of transistor 74, the capacitor 76 is further charged by the increased current flow through the collector-emitter terminals of transistor 74. This further charging of capacitor 76 operates to increase the voltage thereacross by approximately 2 volts so as to result in a charge across the capacitor 76 of approximately 8.5 VDC.

Upon termination of the operation of oscillator 12, the output voltage on capacitor 16 begins to decay towards its predetermined minimum value as the capacitor 16 discharges. As is now readily apparent, capacitor 76 incurs its additional charge by way of the conducting transistor 74 before the output voltage at line 18 can decay below the value at which the zener diode 78 again assumes its substantially non-conductive state. Whereas the zener diode 78 inherently has a very small hysteresis, there is only required a very slight decay in the output voltage before the zener diode 78 switches back to its substantially non-conductive state so as to inhibit the flow of current to the base terminal at transistor 74 thereby returning transistor 74 to its substantially non-conductive state.

Were it not for the capacitor 76, such action would then result in the transistor 54 becoming substantially non-conductive so as to restart the operation of the oscillator 12 to reinstate the charge on capacitor 16. Since the zener diode 78 has such an inherently low hysteresis, such a restart of the operation of the oscillator 12 would occur very rapidly and result in a too frequent on-off cycling of the oscillator. However, due to the increased voltage charged on the capacitor 76 by the transistor 74, it is now apparent that the dicharge of the capacitor 76 will maintain the transistor 54 in a state of conduction subsequent to the turning off of transistor 74. Thus, the operation of the oscillator 12 remains terminated despite the discharge of the output voltage of storage capacitor 16 to a level below which the zener diode 78 and transistor 74 cease to conduct. The reinitiation of the operation of the oscillator 12 is delayed by the time required to discharge the capacitor 76 during which time the transistor 54 is maintained in a state of conduction. The level to which the capacitor 76 must discharge in order to turn off the transistor 54 and reinstate operation of the oscillator is determined to occur at a time generally corresponding to the time in which the output voltage at conductor 18 decays to the predetermined minimum value which, as previously discussed, was set arbitrarily at 290 VDC.

As is now readily apparent, a simplified control circuit embodying a single zener diode has been provided to terminate the operation of a d-c to d-c converter oscillator when the output voltage thereof increases to a predetermined maximum value and to thereafter restart the operation of the oscillator when the output voltage decays to a predetermined minimum value wherein the difference between the maximum and minimum values may be selectively determined to avoid a too frequent on-off cycling of the oscillator. The difference between the aforementioned minimum and maximum value constitutes the hysteresis of the system which has been greatly increased over the very small inherent hysteresis of the zener diode 78 by itself. In this manner, the circuit provides for the consistent and accurate control of the storage capacitor voltage within a readily set, desired working range while eliminating unnecessary use of the battery voltage which would otherwise result from too frequent a cycling of the oscillator. The control circuit utilizes a minimum of components, including a single zener diode without a unijunction transistor as heretofore required by conventional circuits.

Since certain changes may be made in the above-described embodiment without departing from the scope of the invention herein involved, it is intended that all matter contained in the above description or shown in the accompanying drawing shall be interpreted as illustrative and not in a limiting sense.

What is claimed is:

1. A control circuit for effectively terminating the operation of a d-c to d-c converter oscillator when the output voltage thereof increases to a predetermined maximum value and for restarting the operation of the oscillator when the output voltage thereafter decays to a predetermined minimum value, said control circuit comprising:

a first transistor having a collector terminal, an emitter terminal and a base terminal;

a circuit element connected to become conductive upon the application thereof of a voltage at least equal to a predetermined potential proportional to the predetermined maximum value and connected to render said transistor at least partially conductive in response to the output voltage of the oscillator reaching the predetermined maximum value, said circuit element also being connected to be thereafter substantially non-conductive in response to the output voltage of the oscillator decaying below the predetermined maximum value to render said transistor substantially non-conductive;

a capacitor connected with respect to said transistor so as to charge to a first select potential in response to the rendering of said transistor at least partially conductive, said charging of said capacitor occurring before the output voltage of the oscillator can decay below a value at which said circuit element again becomes substantially non-conductive; and circuit means connected between said transistor and oscillator for terminating the operation of the oscillator in response to the rendering of said transistor at least partially conductive, said circuit means also operating in response to the discharge of said capacitor from said first select potential to second select potential subsequent to the rendering of said transistor substantially non-conductive, thereby maintaining the termination of the operation of the oscillator, said circuit means operating thereafter to restart the operation of the oscillator in response to the voltage of said capacitor reaching said second select potential, said second select potential being determined so as to occur at a time generally corresponding to the time at which the output voltage from the oscillator decays to the predetermined minimum value.

2. The control circuit of claim 1 wherein said circuit means includes a second transistor having a collector terminal, an emitter terminal and a base terminal, said second transistor being connected to be rendered at least partially conductive response to the rendering of said first transistor partially conductive with the oscillator being connected to be maintained inoperative responsive to said second transistor being rendered at least partially conductive, said second transistor also being connected with respect to said capacitor so as to be maintained in its partially conductive state in response to said capacitor discharging from said first select potential to said second select potential.

3. The control circuit of claim 2 wherein said capacitor is in series connection with respect to the collector-emitter terminals of said first transistor so as to be charged in response to the rendering of said first transistor conductive, said capacitor additionally being in direct series connection with respect to the base terminal of said second transistor so as to maintain said second transistor at lest partially conductive responsive to the discharging of sai capacitor subsequent to the rendering of said first transistor substantially non-conductive.

4. The control circuit of claim 3 wherein said first transistor is of the NPN type with the collector terminal thereof being in common connection with respect to said capacitor and said base terminal of said second transistor which is of the PNP type.

5. The control circuit of claim 1 wherein said circuit element comprises a zenor diode having one terminal thereof connected to said first transistor base terminal with the other terminal of said zenor diode being connected in voltage sensing relation to the output voltage of the oscillator such that an increase in the output voltage of the oscillator above the predetermined maximum value operates to cause aid zenor diode to conduct current to said first transistor base terminal thereby rendering said first transistor conductive while a decrease in the output voltage of the oscillator below the predetermined maximum value operates to cause said zener diode to become non-conductive to stop the flow of current to said first transistor base terminal thereby rendering said first transistor substantially non-conductive.

6. A capacitor charging circuit for use in electronic flash apparatus of the type having a flashtube together with means for effecting the selective discharge of the capacitor through the flashtube to produce a flash of light, said capacitor charging circuit comprising:

a d-c to d-c converter oscillator;

means for facilitating the connection of said d-c to d-c converter to a direct current voltage source;

a first energy storage capacitor connected to receive an output voltage and charging current from said oscillator; and control circuit means for effectively terminating the operation of said d-c to d-c converter oscillator when said output voltage increases to a predetermined maximum value and for restarting the operation of said oscillator when said output voltage thereafter decays to a predetermined minimum value, said control circuit means including: first transistor having a collector terminal, an emitter terminal and a base terminal; a circuit element connected to become conductive upon the application thereto of a voltage at least equal to a predetermined potential proportional to said predetermined maximum value and connected to render said transistor at least partially conductive in response to the output voltage of said oscillator reaching said predetermine maximum value, said circuit element also being connected to be thereafter substantially non-conductive in response to said output voltage decaying below said predetermined maximum value to render said transistor substantially non-conductive; a second capacitor connected with respect to said transistor so as to be charged to a first select potential in response to the rendering of said transistor at least partially conductive, said charging of said second capacitor occurring before said output voltage can decay below a value at which said circuit element again becomes substantially non-conductive, and electrical means connected between said transistor and oscillator for terminating the operation of said oscillator in response to the rendering of said transistor at least partially conductive, said electrical means also operating in response to the discharge of said second capacitor from said first select potential to a second select potential subsequent to the rendering of said transistor substantially non-conductive to maintain the termination of the operation of said oscillator, said electrical means operating thereafter to restart the operation of said oscillator in response to the voltage of second capacitor reaching said second select potential, said second select potential being determined so as to occur at a time generally corresponding to the time at which said output voltage decays to said predetermined minimum value.

7. The capacitor charging circuit of claim 6 wherein said electrical means include a second transistor having a collector terminal, an emitter terminal and a base terminal, said second transistor being connected to be rendered at least partially conductive responsive to the rendering of said first transistor partially conductive with said oscillator being connected to be maintained inoperative responsive to said second transistor being rendered at least partially conductive, said second transistor also being connected with respect to said second capacitor so as to maintain its partially conductive state in response to said second capacitor discharging from said first select potential to said second select potential.

8. The capacitor charging circuit of claim 7 wherein said capacitor is in series connection with respect to the collector emitter terminals of said first transistor so as to be charged in response to the rendering of said first transistor conductive, said second capacitor additionally being in direct series connection with respect to the base terminal of said second transistor so as to maintain said second transistor at least partially conductive responsive to the discharge of said second capacitor subsequent to the rendering of said first transistor substantially non-conductive.

9. The capacitor charging circuit of claim 8 wherein said first transistor is of the NPN type with the collector terminal thereof being in common connection with respect to said second capacitor and said base terminal of said second transistor which is of the PNP type.

10. The capacitor charging circuit of claim 6 wherein said circuit element comprises a zenor diode having one terminal thereof connected to said first transistor base terminal with the other terminal of said zenor diode being connected in voltage sensing relation to said output voltage such that an increase in said output voltage above said predetermined maximum value operates to cause said zenor diode to conduct current to aid first transistor base terminal thereby rendering said first transistor conductive while a decrease in said output voltage below said predetermined maximum value operates to cause said zenor diode to become non-conductive to stop the flow of current to said first transistor base terminal thereby rendering said first transistor substantially non conductive.

11. An electronic flash apparatus comprising:

a flash tube;

a d-c to d-c oscillator;

means for facilitating the connection of said d-c to d-c converter to a direct current voltage source;

a first energy storage capacitor connected to receive an output voltage and charging current from said oscillator;

means for effecting the selective discharge of said first capacitor through said flash tube to produce a flash of light; and a control circuit for effectively terminating the operating of said d-c to d-c converter oscillator where said output voltage increases to a predetermined maximum value and for restarting the operation of said oscillator when said output voltage thereafter decays to a predetermined minimum value, said control circuit comprising: a first transistor having a collector terminal, an emitter terminal and a base terminal; a circuit element connected to become conductive upon the application thereof of a voltage at least equal to a predetermined potential corresponding to said predetermined maximum value and connected to render said transistor at least partially conductive in response to the output voltage of said oscillator reaching said predetermined maximum value, said circuit element also being connected to be thereafter substantially non-conductive in response to said output voltage decaying below said predetermined maximum value to render said transistor substantially non-conductive; a second capacitor connected with respect to said transistor so as to charge to a first select potential in response to the rendering of said transistor at least partially conductive, said charging of said second capacitor occurring before said output voltage can decay below a value at which said circuit element again becomes substantially non-conductive, and circuit means connected between said transistor and oscillator for terminating the operation of said oscillator in response to the rendering of said transistor at least partially conductive, said circuit means also operating in response to the discharge of said second capacitor from said first select potential to a second select potential subsequent to the rendering of said transistor substantially non-conductive to maintain the termination of the operation of said oscillator, said circuit means operating thereafter to restart the operation of said oscllator in response to the voltage of said second capacitor reaching said second select potential, said second select potential being determined so as to occur at a time generally corresponding to the time at which said output voltage decays to said predetermined value.

12. The electronic flash apparatus of claim 11 wherein said circuit means includes a second transistor having a collector terminal, an emitter terminal and a base terminal, said second transistor being connected to be rendered at least partially conductive responsive to the rendering of said first transistor partially conductive with said oscillator being connectd to be maintained inoperative responsive to said second transistor being rendered at least partially conductive, said second transistor also being connected with respect to said second capacitor so as to maintain its partially conductive state in response to said second capacitor discharging from said first select potential to said second select potential.

13. The elctronic flash apparatus of claim 12 wherein said second capacitor is in series connection with respect to the collector emitter terminals of said first transistor so as to be charged in response to the rendering of said first transistor conductive, said second capacitor additionally being in direct series connection with respect to the base terminal of said second transistor so as to maintain said second transistor at least partially conductive responsive to the discharging of said capacitor subsequent to the rendering of said first transistor substantially non-conductive.

14. The electronic flash apparatus of claim 13 wherein said first transistor is of the NPN type with the collector terminal thereof being in common connection with respect to said second capacitor and said base terminal of said second transistor which is of the PNP type.

15. The electronic flash apparatus of claim 11 wherein saidcircuit element comprises a zenor diode having one terminal thereof connected to said transistor base terminal with the other terminal of said zener diode being connected in voltage sensing relation to said output voltage such that an increase in said output voltage above said predetermined maximum value operates to cause said zener diode to conduct current to said first transistor base terminal thereby rendering said first transistor conductive while a decrease in said output voltage below said predetermined maximum value operates to cause said zener diode to become non-conductive to stop the flow of current to said first transistor thereby rendering said first transistor substantially non-conductive.

* * * * *